United States Patent [19]

Theurer et al.

[11] Patent Number: 4,760,796

[45] Date of Patent: Aug. 2, 1988

[54] BALLAST CLEANING MACHINE WITH COMPACTING DEVICE

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 13,708

[22] Filed: Feb. 12, 1987

[30] Foreign Application Priority Data

Apr. 2, 1986 [EP] European Pat. Off. ..... 8689088.7

[51] Int. Cl.[4] ..... E01B 27/20

[52] U.S. Cl. ..... 104/7.3; 37/104

[58] Field of Search ..... 104/7.1, 7.3; 37/104; 171/16

[56] References Cited

U.S. PATENT DOCUMENTS

| | | | |
|---|---|---|---|
| 748,503 | 12/1903 | Holbrook | 104/7.3 |
| 3,020,853 | 2/1962 | Christoff | 104/7.3 |
| 3,179,062 | 4/1965 | Christoff | 104/7.3 |
| 3,811,382 | 5/1974 | Buchter et al. | 104/7.3 |
| 3,926,123 | 12/1975 | Plasser et al. | 104/7.1 |
| 4,010,691 | 3/1977 | Theurer et al. | 104/7.3 |
| 4,355,687 | 10/1982 | Theurer et al. | 171/16 |

FOREIGN PATENT DOCUMENTS 1157637 11/1963 Fed. Rep. of Germany .

*Primary Examiner*—Robert B. Reeves
*Assistant Examiner*—Scott H. Werny
*Attorney, Agent, or Firm*—Kurt Kelman

[57] ABSTRACT

A mobile ballast cleaning machine comprises a machine frame supporting a ballast excavating and conveying chain, a screening installation and a cleaned ballast redistributing apparatus arranged to receive the cleaned ballast from the screening installation and to redistribute the cleaned ballast at a ballast discharge site behind the ballast excavating site. A cleaned ballast compacting device is arranged at the ballast discharge site, the compacting device comprising a plate-shaped compacting beam extending below the track and transversely thereto to the ballast discharge site, the compacting beam having opposite ends projecting beyond the track, a carrier post supporting each compacting beam end on the machine frame, and a drive connected to each carrier post for continuously reciprocating the compacting beam in a plane extending substantially parallel to the track whereby the cleaned ballast is compacted at the discharge site in a direction opposite to the operating direction.

9 Claims, 1 Drawing Sheet

BALLAST CLEANING MACHINE WITH COMPACTING DEVICE

BACKGROUND OF THE INVENTION

1. Field of the Invention

The present invention relates to a mobile ballast cleaning machine mounted for mobility in an operating direction on a track consisting of rails fastened to ties to excavate ballast supporting the track, to clean the excavated ballast and to redistribute the cleaned ballast under the track. The machine comprises a machine frame supporting a ballast excavating and conveying chain having a section passing transversely under the track for excavating the ballast at an excavating site, a screening installation arranged to receive the excavated ballast from the ballast excavating and conveying chain and to separate waste from the excavated ballast to produce cleaned ballast, a cleaned ballast redistributing apparatus arranged to receive the cleaned ballast from the screening installation and to redistribute the cleaned ballast at a ballast discharge site behind the ballast excavating site, and a cleaned ballast compacting device.

2. Description of the Prior Art

Such a mobile ballast cleaning machine has been disclosed in U.S. Pat. No. 4,355,687, dated Oct. 26, 1982. In this machine, the cleaned ballast leveling and compacting device is mounted behind the cleaned ballast discharge site and comprises a leveling device including a pair of endless ballast leveling chains for distributing the redistributed cleaned ballast over the ballast bed and for leveling the distributed cleaned ballast, a vertical pivot supporting each endless ballast leveling chain for pivoting inwardly from a respective ballast bed shoulder in a plane underneath the track, a rotary drive for driving each ballast leveling chain, and a power drive linking each ballast leveling chain to the machine frame for vertically adjusting the ballast leveling chain. The power drive is connected to a parallelogram guide mechanism mounting each ballast leveling chain on the machine frame for horizontal and vertical adjustment. A ballast compacting device is arranged rearwardly of the ballast leveling chains in the operating direction and is comprised of a vibratory beam extending transversely to the track and having respective ends preferably resiliently connected to elongated carriers at the respective sides of the machine frame. The unevenly discharged cleaned ballast is leveled by the leveling chains and the leveled cleaned ballast is then compacted by the vibrating beam engaging the surface of the leveled cleaned ballast. This leveling and compacting device takes up a considerable amount of space since it is comprised of separate leveling and compacting units and often requires a rather high track lift since the two vertically adjustable units are positioned between the level of the cleaned ballast bed and the track. On the other hand, the ballast compaction is not always sufficient since the unevenly distributed cleaned ballast causes gaps in the ballast bed. This is of particular disadvantage where these gaps occur at the points where the ties are supported on the ballast.

SUMMARY OF THE INVENTION

U.S. Pat. No. 4,010,691, dated March 8, 1977, also discloses a mobile ballast cleaning machine of the general type hereinabove described and including a cleaned ballast leveling apparatus consisting of an arrangement of a central rod-like bar extending parallel to the track ties over the entire length thereof and two outer rod-like bars. The ends of the central bar are pivotally joined to respective inner ends of the outer bars, and elongated guide elements freely movably connect the outer ends of the outer bars and the joined ends of the central and outer bars to a guide frame. This leveling apparatus is pulled along by the advancing machine and will tend to level the cleaned ballast but the relatively uneven distribution of the cleaned ballast makes gaps in the leveled ballast bed unavoidable.

German patent No. 1,157,637, published Nov. 21, 1963, discloses a ballast cleaning machine which comprises ballast compacting rams underneath the track ties for compacting the redistributed cleaned ballast. The ballast compacting rams are moved against the redistributed cleaned ballast in a direction opposite to the operating direction of the machine, a force reacting to the ram movement against the cleaned ballast causing forward movement of the machine in the operating direction.

It is the primary object of this invention to improve the cleaned ballast bed and to distribute the cleaned ballast in such a manner that the track will be optimally supported thereon.

The above and other objects and advantages are accomplished by the invention with a cleaned ballast compacting device arranged at the ballast discharge site and comprising a plate-shaped compacting beam extending below the track and transversely thereto at the ballast discharge site, the compacting beam having opposite ends projecting beyond the track. A carrier post supports each compacting beam end on the machine frame, and a drive is connected to each carrier post for continuously reciprocating the compacting beam in a plane extending substantially parallel to the track whereby the cleaned ballast is compacted at the discharge site in a direction opposite to the operating direction.

Such a compacting device enables the redistributed cleaned ballast discharged on the excavated track bed through the spaces between the ties to be immediately repositioned and continuously compressed under the ties, too, the resistance of the ballast causing compaction thereof. Therefore, the track is supported immediately after the cleaned ballast redistribution at a desired and controllable level on a pre-compacted ballast bed so that the pressure of the succeeding undercarriage of the mobile ballast cleaning machine will further compact the ballast to provide a uniform track support. The use of a plate-shaped compacting beam enables the compacting motion to be effected directly in the ballast bed under the track, which has the advantage that the track does not have to be lifted above the desired level in the range of the compacting device and the underside of the ties may, therefore be used to oppose the compacting movements.

BRIEF DESCRIPTION OF THE DRAWING

The above and other objects, advantages and features of the invention will become more apparent from the following detailed description of certain now preferred embodiments thereof, taken in conjunction with the partially schematic drawing wherein.

DESCRIPTION OF THE PREFERRED EMBODIMENTS

Figures 1, 2, 3, 4:
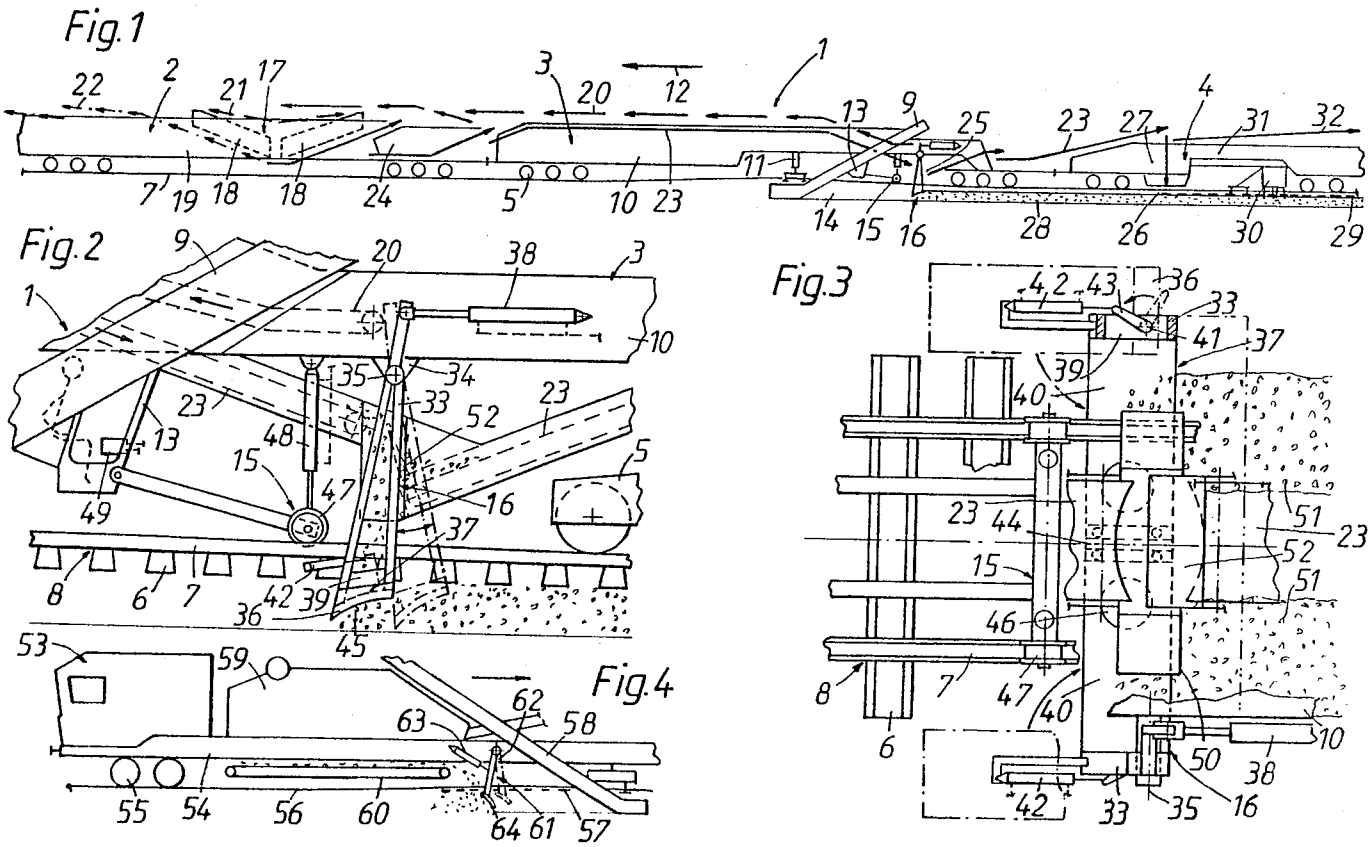
FIG. 1 is a simplified and diagrammatic side elevational view of a mobile ballast cleaning machine according to the present invention.
FIG. 2 is a fragmentary and enlarged side elevation showing the cleaned ballast compacting device of the machine.
FIG. 3 is a top view of the compacting device of FIG. 2.
FIG. 4 is a fragmentary view similar to FIG. 1 and showing another embodiment of the machine.

Referring now to the drawing and first to FIGS. 1 to 3, there is shown mobile ballast cleaning machine 1 comprising a machine frame. In the illustrated embodiment, this machine frame is constituted by a train of three connected work vehicles 2, 3 and 4. The ballast cleaning machine is mounted on undercarriages 5 for mobility in an operating direction indicated by arrow 12 on track 8 consisting of rails 7 fastened to ties 6 to excavate ballast supporting track 8, to clean the excavated ballast and to redistribute the cleaned ballast under the track.

Ballast excavating and conveying chain 9 is supported on machine frame 10 of center work vehicle 3 and has a section passing transversely under track 8 for excavating the ballast at excavating site 14. The ballast excavating and conveying chain is an endless chain driven in a substantially triangular path for excavating and conveying the ballast, as is conventional. Track lifting device 11 is vertically adjustably mounted on machine frame 10 for raising the track at the excavating site. Furthermore, machine frame 10 carries operator's cab 13 above and immediately behind the excavating site, in the operating direction. Central control 49 enables an operator in the cab to control the operation.

Screening installation 17 is supported on machine frame 19 of work vehicle 2 preceding work vehicle 3 and is arranged to receive excavated ballast from ballast excavating and conveying chain 9 and to separate waste from the excavated ballast to produce clean ballast. The illustrated ballast cleaning installation comprises two screening units 18 equipped with independently operable vibrating means and arranged sequentially in, and symmetrically with respect to a vertical plane extending transversely to, the operating direction, and the obliquely extending screens ascending from a centrally located common outlet to two separate inlets for the excavated ballast. The excavated ballast is conveyed from the discharge end of the ballast excavating and conveying chain to the inlets of the two screening units by conveyor band 20, diagrammatically indicated by a series of arrows and two feeding conveyor bands 21, also diagrammatically indicated by a series of arrows. The waste coming from the screening installation is removed by conveyor band 22 diagrammatically indicated by a series of chain-dotted arrows.

Cleaned ballast redistributing apparatus 23 is arranged to receive the cleaned ballast from screening installation 17 and to redistribute the cleaned ballast at a ballast discharge site behind ballast excavating site 14. This apparatus comprises a series of successive conveyor bands, a first one of which is disposed below the outlet of the screening installation for receiving the cleaned ballast therefrom and to convey it to intermediate ballast storage container 24 whence it is moved to first cleaned ballast output 25 at the discharge site and second cleaned ballast output 26 on rear work vehicle 4. First cleaned ballast outlet 25 produces first layer 28 of cleaned ballast on the excavated track bed below track 8 and second cleaned ballast output 26 is constituted by adjustable discharge openings in storage container 27 for forming second layer 29 filling the cribs.

As best shown in FIG. 3, first cleaned ballast output 25 is constituted by a schematically illustrated ballast distributing chute 50 with two discharge openings extending transversely to the track for forming two ballast support strips 51 for track ties 6. For dividing the cleaned ballast into a first portion discharged at output 25 and a residual portion conveyed to second output 26, a ballast flow deflector 52 is mounted pivotally about an axis extending transversely to the track. The screening installation and the cleaned ballast redistributing apparatus are more fully described and claimed in a U.S. Pat. application Ser. No. 13,710, filed Feb. 12, 1987, by one of the joint inventors, Josef Theurer, and entitled "Ballast Cleaning Machine".

Machine frame 31 of rear work vehicle 4 supports operating unit 30 holding track tamping heads and a track lifting and lining device, the operating unit being displaceable on the machine frame in the operating direction. Cleaned ballast redistributing apparatus 23 further includes extension conveyor band 32 extending rearwardly from ballast storage container 27 beyond a rear end of work vehicle 4. A pivotal ballast flow deflector is mounted at an inlet end of conveyor band 32 to direct all or a selected amount of cleaned ballast to ballast storage container 27 or to move excess cleaned ballast rearwardly. All of the conveyor bands are preferably trough-shaped to prevent ballast or waste from spilling over the sides of the conveyor bands. All of these arrangements are described in more detail and claimed in a U.S. patent application Ser. No. 13,709, filed simultaneously herewith by one of the joint inventors, Josef Theurer, and entitled "Mobile Ballast Cleaning Apparatus".

As best shown in FIGS. 2 and 3, a cleaned ballast compacting device 16 is arranged at the ballast discharge site and, according to the present invention, this compacting device comprises plate-shaped compacting beam 37 extending below track 8 and transversely thereto at the ballast discharge site, i.e. in the range of first cleaned ballast output 25. The compacting beam has opposite ends projecting beyond the track and a vertical carrier post 33 supports each compacting beam end on machine frame 10 laterally of the track. Drive 38 is connected to each carrier post 33 for continuously reciprocating compacting beam 37 in a plane extending substantially parallel to track 8 whereby the cleaned ballast is compacted at the discharge site in a direction opposite to the operating direction indicated by arrow 12. In the illustrated embodiment, each carrier post is a lever pivoted to the machine frame at pivot bearing 34 for pivoting about axis 35 extending transversely to the track and has an upper arm and a fork-shaped lower arm. The ends of the fork-shaped lower arms of the carrier posts are connected by plates 39 and have reinforcing plates 36 supporting the compacting beam ends. Reciprocating drives 38 are cylinder-piston drives linking the upper lever arms of the carrier posts to machine frame 10.

The illustrated ballast compacting beam is a two-part beam, each of the compacting beam parts having a respective one of the ends, and is comprised of two halves 40 forming a mirror image with respect to a longitudinally extending, vertical plane of symmetry of machine frame 10, and each compacting beam half 40 is pivoted to supporting post 33 for pivoting about vertical axis 41 into an inoperative position laterally adjacent the track, as shown in chain-dotted lines in FIG. 3, and drive 42 connects each compacting beam half 40 to supporting carrier post 33 for pivoting the compacting beam half. Stiffening plate 44 releasably connects the free ends of compacting beam parts 40 in the plane of symmetry, and release of the stiffening plates enables the compacting beam parts to be reciprocated independently by a respective drive 38. Vertical pivoting axis 41 for each compacting beam half 40 is constituted by crank shaft 43 whose lower end is rotatably journaled in connecting plate 39 and is connected to reinforcing plate 36 which holds the compacting beam half, and whose upper end is connected to drive 42.

The two-part construction of the compacting beam has the advantage of enabling the compacting beam to be rapidly placed into and out of operation, simply by swinging the compacting beam halves into a rest position on the track shoulders and an operative position under the track ties. Connecting the two compacting beam halves with a stiffening plate increases the rigidity of the compacting beam during operation in a very simple manner, which improves the ballast compaction and also enables the compacting beam to withstand the continuous, cyclic impact motions. By arranging the carrier posts as two-armed levers, a very simple, yet efficient transmission of the driving forces to the beam will be assured to obtain high ballast compaction forces.

The illustrated ballast compacting beam has convexly curved compacting surface 45 extending between a transverse lower edge and a transverse upper edge, surface 45 facing the cleaned ballast at the discharge site. The lower edge precedes the upper edge in the operating direction and the upper edge is close to a plane defined by the undersides of ties 6. Reinforcing plate 36 affixes each compacting beam end to carrier post 33 supporting this end. The convex shape of the compacting surface provides a large area of contact between the compacting beam and the cleaned ballast thrown onto the excavated track bed so that the cleaned ballast will be rapidly moved and compacted evenly under the track ties. Also, the curved beam will automatically assure that any cleaned ballast falling onto the beam from outlet 25 moves downward to the excavated track bed. The reinforcing plates will assure a strong connection between the support posts and the beam so that the compacting device may withstand strong forces.

A vibrating drive 46 is connected to each compacting beam half 40, the vibration superimposed upon the cyclic reciprocating motion of the compacting beam increasing the compacting effect, on the one hand, and causing any ballast falling on the beam to flow down more rapidly.

As best shown in FIG. 2, a track depressing device 15 is linked to machine frame 10 and precedes ballast compacting device 16 in the operating direction. The track depressing device comprises a pair of flanged wheels 47 engaging track rails 7 and vertically adjustable drive means 48 connecting the track depressing device to the machine frame. In this manner, a controllable downward pressure force may be superimposed on the weight of the track to increase the compaction of the underlying ballast even further. In addition, the track depressing device will prevent uncontrolled raising of the track under the upward pressure of the compacted ballast so that the track can be held at an accurate and uniform level.

Ballast cleaning machine 1 illustrated in FIGS. 1 to 3 operates in the following manner:

While the machine advances continuously in the operating direction indicated by arrow 12, the dirty and encrusted ballast is continuously excavated and conveyed upwardly by chain 9 to conveyor band 20 which conveys it to feeding conveyor bands 21, and the latter throw the excavated ballast into screening installation 17. The cleaned ballast redistributing apparatus conveys the cleaned ballast in an opposite direction to cleaned ballast output 25 at the discharge site behind excavating site 14. In the pivotal position of ballast flow deflector 52 shown in FIG. 2, a portion of the cleaned ballast is discharged through ballast distributing chute 50 to the excavated track bed between the ties and another cleaned ballast portion is conveyed to second cleaned ballast output 26 where it flows through the adjustable discharge openings of storage container 27 to form second ballast layer 29 filling the cribs. If the waste component of the excavated ballast is relatively small and there is an excess of cleaned ballast, such excess cleaned ballast is removed to a following freight car, for example, by rear conveyor band 32 after a ballast flow deflector is suitably adjusted to direct the ballast flow to the rear conveyor band. Immediately after the second cleaned ballast layer is formed, the track position is continuously corrected and the ballast is tamped under the ties to hold the corrected track in position by operating unit 30.

The cleaned ballast discharged at first output 25 is compacted by reciprocating compacting device 16 to form first cleaned ballast layer 28. FIG. 2 illustrates the foremost position of the reciprocating compacting device in full lines and its rearmost position, in the operating direction, is shown in chain-dotted lines. At the same time, drive means 48 will depress flanged wheels 47 of track depressing device 15 to hold track 8 at a desired level. The operator in cab 13 can change the frequency of the reciprocating motion of compacting beam 37 in dependence on the quantity of cleaned ballast to be compacted from control panel 49.

After completion of the ballast cleaning operation, drives 42 are operated to swing compacting beam halves 40 into their rest position shown in chain-dotted lines in FIG. 3. This pivoting motion is effected by turning crank shaft 43 by 90° . Afterwards, the compacting beam halves may be lifted above the track level by retracting the piston rods of drive 38.

FIG. 4 illustrates ballast cleaning machine 53 comprising machine frame 54 mounted on undercarriages 55 for mobility in an operating direction indicated by an arrow on a track consisting of rails 56 fastened to ties 57. The machine frame supports ballast excavating and conveying chain 58 and screening installation 59 receiving the excavated ballast from the ballast excavating and conveying chain. Cleaned ballast redistributing apparatus 60 receives the cleaned ballast from the screening installation and throws it onto the excavated track bed at a discharge site. Such mobile ballast cleaning machines are well known.

According to this invention, cleaned ballast compacting device 61 is arranged at the ballast discharge site and comprises convexly curved, plate-shaped compacting beam 64 and carrier posts 62 supporting the opposite ends of the compacting beam. The carrier posts have upper ends pivoted to the sides of machine frame 54 for pivoting about a transverse axis and drives 63 link the carrier posts to the machine frame for continuously reciprocating the compacting beam in a plane extending substantially parallel to the track, as shown in full and chain-dotted lines, whereby the cleaned ballast is compacted at the discharge site in a direction opposite to the operating direction.

At the beginning of a ballast cleaning operation, compacting beam 64 is pushed under the track through a prepared transverse excavation in the ballast and is attached to the free lower ends of carrier posts 61. After the completion of the operation, the compacting beam is detached from the carrier posts so that the machine may be moved on the track to another operating site.

What is claimed is:

1. A mobile ballast cleaning machine mounted for mobility in an operating direction on a track consisting of rails fastened to ties to excavate ballast supporting the track, to clean the excavated ballast and to redistribute the cleaned ballast under the track, which comprises a machine frame supporting (a) a ballast excavating and conveying chain having a section passing transversely under the track for excavating the ballast at an excavating site, (b) a screening installation arranged to receive the excavated ballast from the ballast excavating and conveying chain and to separate waste from the excavated ballast to produce cleaned ballast, (c) a cleaned ballast redistributing apparatus arranged to receive the cleaned ballast from the screening installation and to redistribute the cleaned ballast at a ballast discharge site behind the ballast excavating site, and (d) a cleaned ballast compacting device arranged at the ballast discharge site, the compacting device comprising (1) a plate-shaped compacting beam extending below the track ties and parallel thereto at the ballast discharge site, the compacting beam having opposite ends projecting beyond the track, (2) a carrier post supporting each compacting beam end on the machine frame, and (3) a drive connected to each carrier post for continuously reciprocating the compacting beam in a pendulum motion in a plane extending substantially parallel to the track whereby the cleaned ballast at the discharge site is moved and compacted under the ties in a direction opposite to the operating direction.

2. The mobile ballast cleaning machine of claim 1, wherein each carrier post has an upper end affixed to the machine frame and the compacting beam is comprised of two halves forming a mirror image with respect to a longitudinally extending, vertical plane of symmetry of the machine frame, each compacting beam half being pivoted to the supporting carrier post for pivoting about a vertical axis for swinging into an inoperative position laterally adjacent the track, and a drive connecting each compacting beam half to the supporting carrier post for pivoting the compacting beam half.

3. The mobile ballast cleaning machine of claim 2, further comprising a stiffening plate releasably connecting the compacting beam halves.

4. The mobile ballast cleaning machine of claim 1, wherein the compacting beam is comprised of two parts, each of the compacting beam parts having a respective one of the ends, and each carrier post is a lever pivoted to the machine frame and having an upper and a lower arm, the reciprocating drive being a cylinder-piston drive linking the upper lever arm to the machine frame, and the lower lever arm carrying a respective one of the compacting beam part ends.

5. The mobile ballast cleaning machine of claim 4, further comprising a stiffening plate releasably connecting the compacting beam parts, release of the stiffening plate enabling the compacting beam parts to be reciprocated independently by a respective one of the drives.

6. The mobile ballast cleaning machine of claim 1, wherein the compacting beam has a convexly curved compacting surface extending between a transverse lower edge and a transverse upper edge, the convexly curved compacting surface facing the cleaned ballast at the discharge site, the lower edge preceding the upper edge in the operating direction and the upper edge being close to a plane defined by the undersides of the ties, and further comprising a reinforcing plate affixing each compacting beam end to the carrier post supporting said end.

7. The mobile ballast cleaning machine of claim 1, further comprising a vibrating drive connected to the compacting beam.

8. The mobile ballast cleaning machine of claim 1, further comprising a track depressing device linked to the machine frame and preceding the ballast compacting device in the operating direction, the track depressing device comprising a pair of flanged wheels engaging the trac rails.

9. The mobile ballast cleaning machine of claim 8, further comprising a vertically adjustable drive means connecting the track depressing device to the machine frame.

* * * * *